United States Patent [19]

McCall

[11] 4,135,441

[45] Jan. 23, 1979

[54] INTEGRATED AIR DIFFUSER

[75] Inventor: Francis L. McCall, Hacienda Heights, Calif.

[73] Assignee: Specified Ceiling Systems, Alhambra, Calif.

[21] Appl. No.: 780,237

[22] Filed: Mar. 22, 1977

[51] Int. Cl.[2] ..... F24F 13/08

[52] U.S. Cl. ..... 98/40 D; 98/114

[58] Field of Search ..... 98/40 D, 114, 40 DL

[56] References Cited

U.S. PATENT DOCUMENTS

| | | | |
|---|---|---|---|
| 3,429,250 | 2/1969 | Kodaras | 98/40 D |
| 3,475,869 | 11/1969 | Jahn | 98/40 D |
| 3,688,680 | 9/1972 | Lambert | 98/40 D |

*Primary Examiner*—William E. Wayner

*Attorney, Agent, or Firm*—Christie, Parker & Hale

[57] ABSTRACT

An air diffuser for a modular drop ceiling construction in which an annular discharge opening is defined by the inner margin of the ceiling framework members forming a square or rectangular opening and the outer margin of a ceiling panel positioned concentrically in the opening and suspended at the corners from the framework. Air is directed by a conduit and hood against the backside of the ceiling panel and directed outwardly through the rectangular annular space around the margin of the panel. Lateral airflow outwardly from the diffuser along the adjacent ceiling is provided by shaping the margins of the opening to provide either a beveled or step outline in cross section.

12 Claims, 7 Drawing Figures

Fig. 1
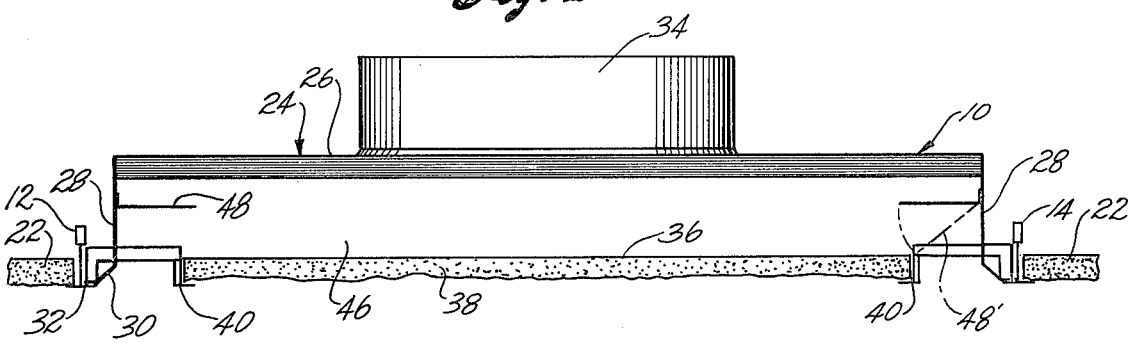
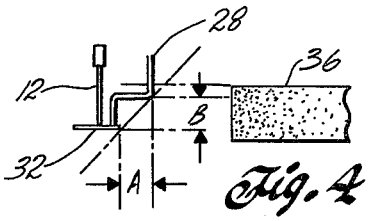
Fig. 4
Fig. 3
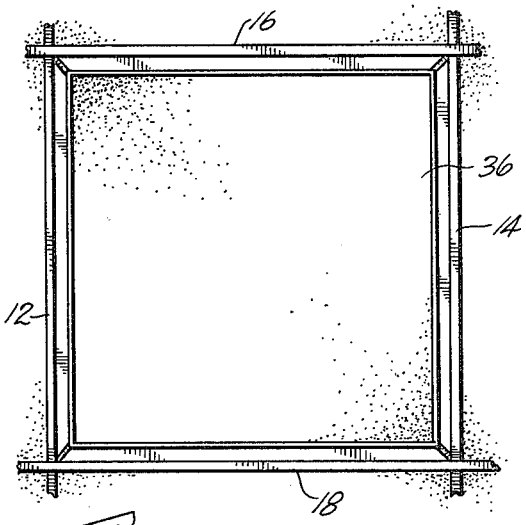
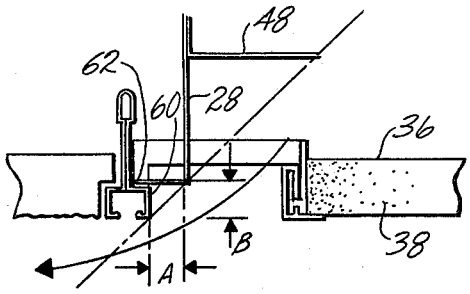
Fig. 5
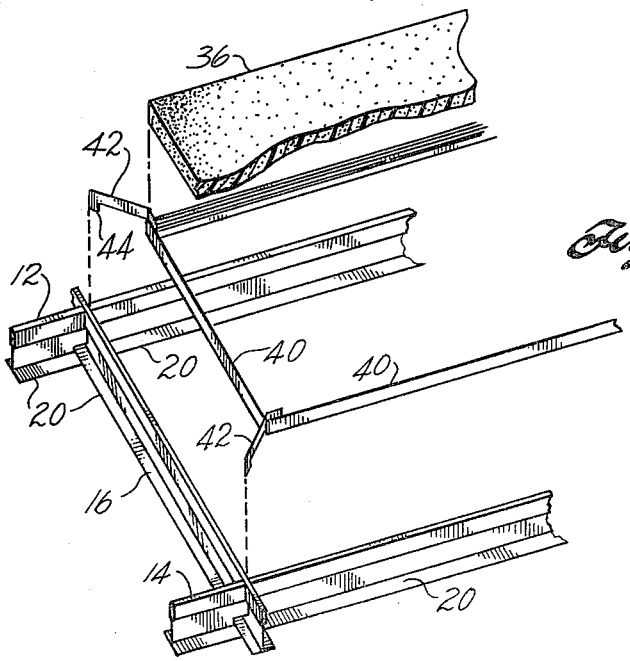
Fig. 2

INTEGRATED AIR DIFFUSER

FIELD OF THE INVENTION

This invention relates to air diffusers for directing air into a room through the ceiling.

BACKGROUND OF THE INVENTION

Air diffusers are well known which provide a plenum chamber above the ceiling from which air discharges into a room through suitable openings in the ceiling. Such known diffusers require an air deflection surface which is approximately at or below the lower plane of the ceiling to direct the air in a lateral pattern as it enters the room through the ceiling. It has been the practice to make the air deflecting member part of or in direct contact with the suspension member or the ceiling trim. This air deflecting member forms a ledge and must be made of a very thin sheet metal or the like which is substantially flush with the bottom surface of the ceiling or lower in order to get the proper discharge flow pattern. This results in a visible detail in the diffuser which may be architecturally or aesthetically undesirable. The deflection ledge width usually is 50% to 75% of the width of the discharge opening adding to the visible detail required of such a diffuser design. Such a diffuser is described, for example, in U.S. Pat. No. 3,406,623.

SUMMARY OF THE PRESENT INVENTION

The present invention provides an improved diffuser of simple construction which provides an effective air pattern control that projects the air substantially horizontally away from the diffuser along the ceiling. The diffuser uses a standard acoustical tile type ceiling panel as the air deflecting surface thus utilizing a deflector surface which is necessarily recessed into the ceiling by an amount equal to the thickness of the ceiling tile. The present invention provides a horizontal discharge pattern from this recessed air deflecting surface thereby avoiding any need of aesthetically undesirable metallic deflecting surfaces being provided flush with the surface on the ceiling, as has been required in known prior art diffusers.

In brief, the air diffuser of the present invention fits in and forms one module of a drop ceiling having a grid-like framework. The air diffuser includes a sheet metal hood adapted to fit one of the openings formed by the framework and be supported on the framework. An inner frame within the hood supports an acoustical tile panel concentrically within the opening of the framework, the panel and framework forming a square or rectangular shaped annular orifice through which air is discharged. The backside of the panel and the hood combine to form an air plenum chamber, air being admitted to the chamber through a duct which directs air under pressure against the backside of the panel. The backside of the panel form an air deflecting surface directing the air horizontally outwardly and through the annular discharge opening around the margin of the panel. The bottom of the panel is flush with the surrounding ceiling. The framework in combination with the hood structure forms a beveled or stepped cross sectional configuration at the margin of the annular discharge opening, which causes the air to move outwardly of the diffuser in a pattern extending substantially parallel to the surrounding ceiling. Thus the diffuser provides the desired horizontal flow along the ceiling after discharge from the diffuser.

DESCRIPTION OF THE DRAWINGS

For a better understanding of the invention, reference should be made to the accompanying drawings wherein:

FIG. 1 is a sectionalized side view of the preferred embodiment of the air diffuser;

FIG. 2 is a partial exploded view showing the inner panel supporting frame construction of the embodiment of FIG. 1;

FIG. 3 is a plan view of the ceiling with the diffuser installed;

FIG. 4 is a detailed sectional view of an alternative embodiment;

FIG. 5 is a detailed sectional view of yet another embodiment; and

DETAILED DESCRIPTION OF THE DRAWINGS

Figure 6:
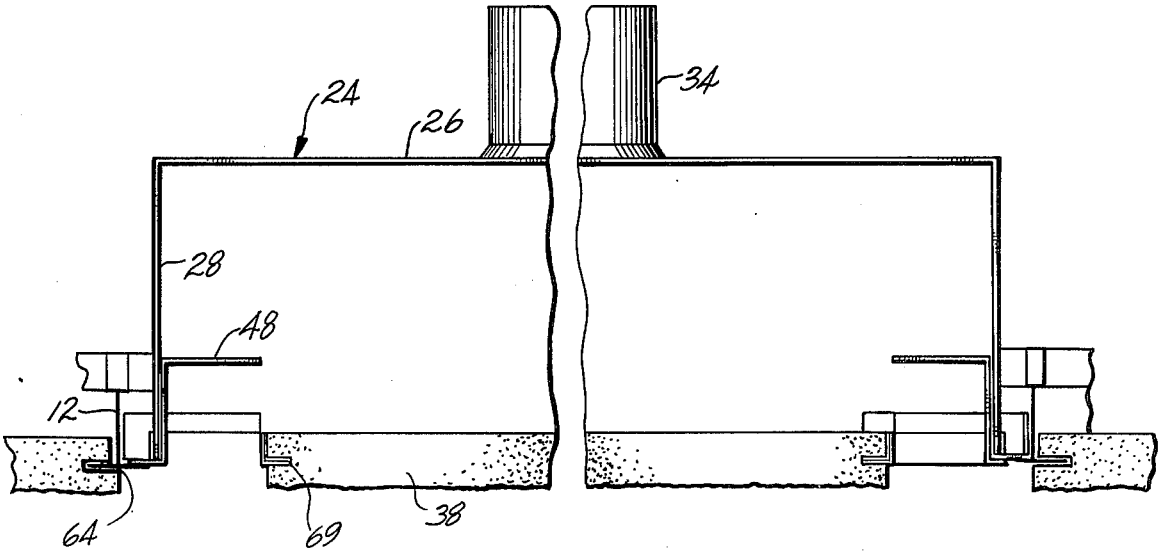
FIG. 6 is a detailed sectional view of a further embodiment.

Referring to the embodiment shown in FIGS. 1–3, the numeral 10 indicates generally an air diffuser assembly according to the present invention adapted to be mounted in a suspended ceiling. Such ceilings are well known and in typical installations consist of a framework of longitudinal and lateral runners made of extruded aluminum or rolled steel, such as indicated at 12, 14, 16 and 18. The runners usually have inverted T-shaped which forms a pair of projecting horizontal bottom flanges 20. These flanges provide support for panels of acoustical tile or the like, such as indicated at 22, which fit into and close off the openings in the grid-like framework to form the surface of the ceiling. The framework can be designed with standard 2′ and/or 4′ intervals between centers. The diffuser of the present invention is preferably designed to fit into a 2′ square framework but may be designed for a 2′ by 4′ framework opening.

The air diffuser 10 includes a sheet metal hood 24 having a flat top surface 26 and four vertical side walls 28. The lower margins of the side walls 28 are flared outwardly in two steps, the first step being a beveled section 30 extending an angle of 40° to 45° or less to the horizontal, and a horizontal outer section 32 which is dimensioned to rest on one of the flanges 20 of the surrounding T-shaped framework.

Air is directed into the hood 24 of the air diffuser 10 through a standard circular air duct which is connected to the hood 24 by a collar 34 projecting upwardly from the top surface 26 of the hood 24 at the center thereof. Air entering under slight pressure through the duct is admitted to the hood through the collar 34, the air flowing downwardly through the cellar into the interior of the hood.

The air admitted to the hood impinges directly on the upper or back surface 36 of a central panel 38 formed of a piece of conventional ceiling tile supported on an inner frame 40. The frame 40 is constructed of angle strips which form inwardly projecting flanges on which the margins of the ceiling tile panel 38 are supported. The frame 40 is of the same outline shape but smaller in dimension than the opening formed by the surrouding ceiling framework. The inner frame 40 is in turn supported at each corner from the ceiling framework by supporting brackets 42 secured to the inner frame 40 at each corner. The brackets project diagonally outwardly at each corner, the outer ends of the brackets 42 being formed with downward projections 44 which engage the top surface of the intersecting flanges 20 at each corner of the associated opening in the ceiling framework. In this manner, the corner brackets 42 support the inner frame 40 so that the lower edge of the frame 40 is flush with the bottom flanges 20 of the T-shaped framework members. Thus the acoustical tile panel 38 when inserted in the frame 40 provides a ceiling surface which is flush with the surrounding acoustical ceiling tile supported by the ceiling framework.

The corners of the hood 26 are provided with slots which allow the hood to fit over the supporting brackets 42 into engagement with the supporting framework flanges 20. The hood 24 and central panel 38 combine to form an air plenum 46 chamber having a square annular shaped air discharge opening formed by the space or gap between the margin of the flanges 20 and the inner frame 40. The air entering into the collar 34 impinges on the back surface 36 and is deflected outwardly in all directions through the annular discharge opening extending around the inner margin of the hood 24.

It is essential that air discharged from the diffuser move substantially horizontally along the ceiling surface and not more directly downward. The desired pattern is established at the opening by a pattern control baffle 48 which is supported on the inside of the sidewalls of the hood 24. The baffle 48 extends around all four sides of the hood and projects inwardly in a plane substantially parallel to the back surface 36 of the ceiling panel 38. The baffle 48 extends inwardly a distance slightly greater than the width of the discharge opening. The baffle 48 along each side can be individually bent downwardly, as indicated by the dotted line 48', to reduce or shut off the discharge of air along any side of the hood.

One of the unique aspects of the present invention is that a ceiling tile provides the deflecting surface 36. However, this requires that the deflecting surface be recessed above the plane of the ceiling surface by the thickness of the ceiling tile 38 which typically is ⅝" to ¾". The air discharge opening between the outer margin of the inner frame 40 and the margin of the flange portion of the T-shaped framework is approximately 2" in width. Nevertheless by the present invention a substantially horizontal or near horizontal flow of air away from the discharge opening along the surface of the ceiling is achieved without any air flowing vertically downwardly from the discharge opening. This is accomplished even with the recessed defelecting surface 36 by the design detail of the margin of the hood in combination with the supporting framework.

Particularly in the embodiment of FIG. 1 this is achieved by extending the side walls 28 of the hood vertically downwardly at or below the plane of the deflecting surface 36 to a plane more nearly midway between the top and bottom surfaces of the panel 38, then flaring the hood outwardly at an angle of 45° or less to the horizontal to the edge of the supporting flange 32. Alternatively, rather than having a beveled edge section 30, the hood sidewall 28 of the hood 24 can be formed at the margin with an offsetting step as shown in FIG. 4. To achieve the desired flow pattern, the step must be formed with the lower margin of the sidewall 28 terminating below the deflecting surface 36 of the center panel 38 near the midplane of the panel. The extent of the offset must be such that the lower margin of the sidewall 28 of the hood and the inner edge of the flange portion 32 of the supporting T-shaped frame member 12 lie in a common plane which extends at an angle of 45° or less to the horizontal. Stated another way, the dimension B in FIG. 4 should be approximately equal to half the thickness of the panel 36. The dimension A should be equal to or larger than dimension B to achieve the desired airflow pattern. The beveled edge of FIGS. 1–3 and the offset edge of FIG. 4 both have proved effective in achieving the desired air discharge flow pattern.

Alternative designs are also shown in FIGS. 5 and 6. FIG. 5 shows an arrangement in which the ceiling framework is made of runner sections shaped with a channel design, such as described in application Ser. No. 569,287 filed Apr. 18, 1975, entitled, "Modular Ceiling Framework" issued as U.S. Pat. No. 4,021,986. In this arrangement the sides of the lower channel portion of the framework, indicated at 60, determines the dimension B. The hood 24 is formed with a flange portion 62 which rests on top of the channel portion of the frame runner, the side wall 28 of the hood being offset inwardly from the side 60 of the channel to form the dimension A. It will be seen that dimensionally the arrangement of FIG. 5 provides substantially the same configuration at the margin of the hood as the arrangement shown in FIGS. 1–4, thereby achieving the same desired airflow pattern by using the back surface 36 of the panel 38 as the air deflecting surface.

In another embodiment, shown in FIG. 6, the ceiling tiles themselves are used to form the margins of the air discharge openings. In this arrangement the ceiling tiles are supported by being provided with a slot 64 along the edges which receive the flanges 20 of the T-shaped framework runners 12. The panel 38 may similarly be provided with a slot 64 which is engaged by the inner lip of the L-shaped inner frame members 69. The surrounding tiles and the central panel are flush with the margins of the central panel conbining with the margins of the surrounding tiles forming the annular discharge opening. The margins of the surrounding tiles combine with the hood to form the step configuration necessary to achieve the desired air flow pattern.

Figure 7:
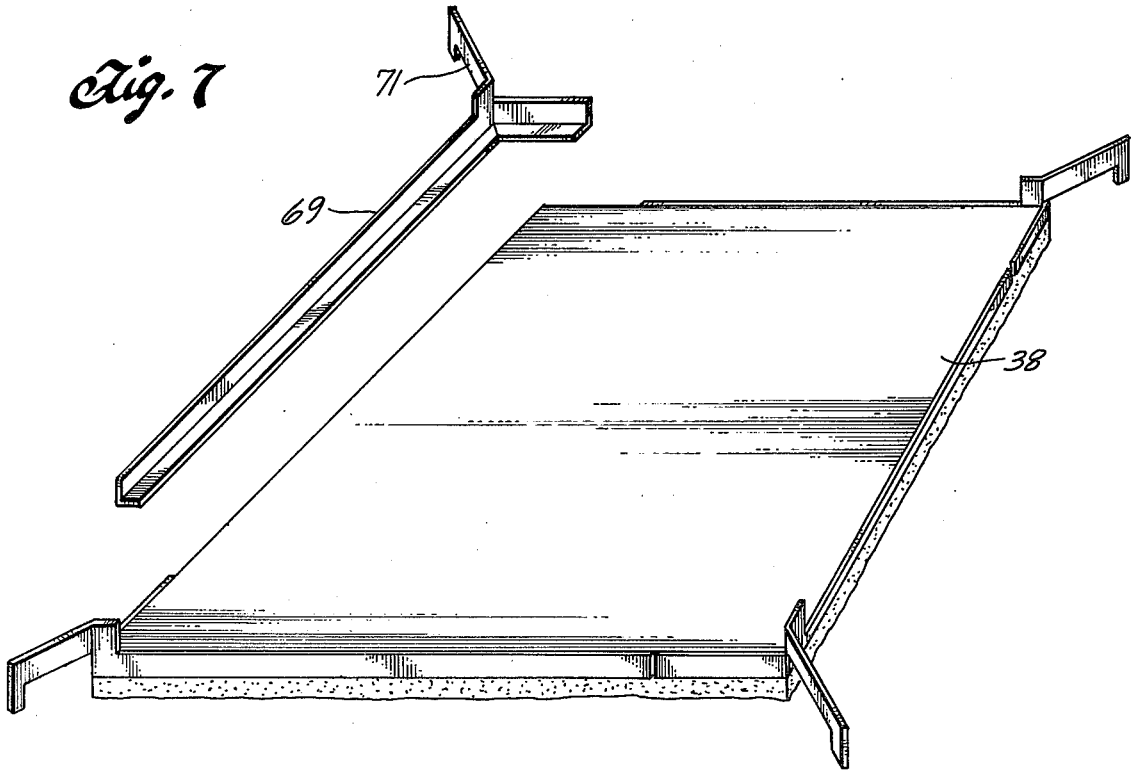
FIG. 7 is a perspective view of the mounting for the ceiling panel within the diffuser.

The frame members 69 are shown in more detail in FIG. 7. Each frame member consists of two L-shaped portions joined at right angles so as to engage a corner and substantially all of one side of the ceiling panel 38. An integral supporting bracket 71 is attached to the member 69 at the corner formed by the two L-shaped portions and extends diagonally outwardly to provide a support for the panel member. Once in place, the supporting bracket 71 which fits tightly into the corners of the grid-like supporting framework 12, in the same manner as shown in FIG. 3.

What is claimed is:

1. A ceiling mounted air diffuser system for directing air through an opening in the ceiling in an air flow pattern extending horizontally along the surface of the ceiling, comprising a grid-like framework, ceiling panels supported by the framework, the panels having substantially flat horizontal top and bottom surfaces, the framework and one of the ceiling panels having an elongated opening between the panel and the adjacent edge of the framework, means forming an air plenum chamber above the opening, the means forming an air plenum chamber having a side wall engaging the framework and forming a margin of said elongated opening, means directing air into the plenum chamber toward the top surface of the panel, the portion of the top surface of the panel adjacent the opening forming a recessed horizontal deflection surface at the bottom of the plenum chamber, the width of said elongated opening being widest at the lowest margin of the opening and decreasing in width at a horizontal plane intermediate the plane of the bottom surface of the ceiling panel and the plane of the top surface of the panel.

2. The apparatus of claim 1 wherein the opening decreases in width in step-wise fashion between the plane of the bottom surface of the panel and the plane of the top surface of the panel.

3. The apparatus of claim 1 wherein the opening decreases in width between the planes of the upper and lower surfaces of the panel by providing a surface extending substantially 45° to the plane of the lower surface of the ceiling.

4. An air diffuser for a suspended ceiling of a type having a grid-like framework having a lip formed along the margins of the framework for supporting acoustical ceiling tiles or the like, the diffuser comprising: an open hood adapted to fit one of the openings formed by the grid-like framework, the sides of the hood being adapted to engage said lips to support the hood on the framework, an inner frame mounted inside the hood concentric with the sides of the hood, the inner frame and surrounding sides of the hood forming an annular space, panel means mounted in the inner frame forming a barrier to air flow through the inner frame and having a top planar surface forming a plenum chamber with the hood, means for directing air under pressure into the plenum chamber against the top surface of said panel means, the air being deflected by the panel means out of the plenum chamber through the annular space between the sides of the hood and the inner frame.

5. Apparatus of claim 4 further including a pattern control baffle projecting from the sides of the hood horizontally inwardly on the inside of the hood a distance overlapping the margin of the inner frame, the baffle being above the top surface of the panel means.

6. The apparatus of claim 5 wherein the panel means has a bottom planar surface substantially flush with the bottom of the framework and forming the ceiling surface.

7. The apparatus of claim 4 wherein the side walls of the hood are formed with an edge intermediate the plane of the surface of the ceiling and the top planar surface of panel means, the ammular opening being wider below said edge than above said edge.

8. The apparatus of claim 7 wherein the margins of the opening formed by the outer framework are horizontally offset from the sides of the hood below said edge in a direction outwardly from the inner frame.

9. The apparatus of claim 8 wherein the offset is formed by flaring the lower margins of the side walls of the hood outwardly at substantially a 45° angle below said edge.

10. An air diffuser comprising an outer framework forming a rectangular opening, a ceiling panel positioned in said opening, means supporting the panel from the framework with an open space between an edge of the panel and at least a portion of the framework, means forming a plenum chamber above said open space, the plenum chamber extending laterally beyond said edge of the panel with the top surface of the panel forming a horizontal surface within the plenum chamber, means for directing air into the chamber, said horizontal surface deflecting the air toward said open space, the margin of said open space opposite the edge of the panel being shaped such that the width of the open space is substantially greater at the bottom plane of the panel than at the top plane of the panel.

11. Apparatus of claim 10 wherein the framework has an inverted T-shape forming a ledge at the margin of said open space, the means forming a plenum chamber having an outer wall supported on said ledge, the outer wall of the plenum chamber extending inwardly away from the framework and toward the panel in the region between the top and bottom planes of said panel to reduce the width of the open space at the top plane of the panel compared to the width at the bottom plane of the panel.

12. Apparatus of claim 10 where the framework is an inverted channel shape with the bottom of the channel shaped portion lying in the bottom plane of said ceiling panel and the top of the channel shaped portion lying in a plane intermediate the top and bottom planes of the panel, the plenum chamber having an outer wall extending downwardly and outwardly to the top of the channel shaped portion.

* * * * *